US007677841B2

(12) United States Patent
Shin et al.

(10) Patent No.: US 7,677,841 B2
(45) Date of Patent: Mar. 16, 2010

(54) METHOD OF BUILDING A RETAINING WALL STRUCTURE

(75) Inventors: Seung Jong Shin, 303, Plusvill, 486-12, Seongnae-dong, Gangdong-gu, Seoul 134-030 (KR); Byeong Kuk Kwon, Busan (KR)

(73) Assignee: Seung Jong Shin, Seoul (KR)

( * ) Notice: Subject to any disclaimer, the term of this patent is extended or adjusted under 35 U.S.C. 154(b) by 3 days.

(21) Appl. No.: 12/090,204

(22) PCT Filed: Dec. 14, 2005

(86) PCT No.: PCT/KR2005/004311

§ 371 (c)(1),
(2), (4) Date: Apr. 14, 2008

(87) PCT Pub. No.: WO2007/046570

PCT Pub. Date: Apr. 26, 2007

(65) Prior Publication Data

US 2008/0286055 A1 Nov. 20, 2008

(30) Foreign Application Priority Data

Oct. 18, 2005 (KR) ..... 10-2005-0097879

(51) Int. Cl.
*E02D 29/02* (2006.01)

(52) U.S. Cl. ..... 405/284; 405/17; 405/18

(58) Field of Classification Search ..... 405/15, 405/16, 17, 18, 21, 107, 114, 115, 116, 111, 405/284; 411/457, 470, 920, 921
See application file for complete search history.

(56) References Cited

U.S. PATENT DOCUMENTS

| | | | | | |
|---|---|---|---|---|---|
| 1,412,582 | A | * | 4/1922 | Vaile | 411/457 |
| 2,867,807 | A | * | 1/1959 | Anstett | 411/920 |
| 3,922,832 | A | * | 12/1975 | Dicker | 405/107 |
| 3,969,975 | A | * | 7/1976 | Krol | 411/457 |
| 4,486,121 | A | * | 12/1984 | Thompson et al. | 405/17 |
| 4,650,368 | A | * | 3/1987 | Bayer | 405/107 |
| 5,588,784 | A | | 12/1996 | Brandl et al. | 405/262 |
| 5,934,027 | A | * | 8/1999 | Khalili | 405/84 |
| D484,032 | S | * | 12/2003 | Del Re | D8/390 |
| 7,083,364 | B2 | * | 8/2006 | Kim | 405/284 |
| 7,452,164 | B2 | * | 11/2008 | Kim | 405/284 |

FOREIGN PATENT DOCUMENTS

| | | | |
|---|---|---|---|
| JP | 07166551 | A * | 6/1995 |
| JP | 08020950 | A * | 1/1996 |
| JP | 2002-541368 | | 12/2002 |
| KR | 20-0185875 | | 4/2000 |
| KR | 20-0354134 | | 6/2004 |

OTHER PUBLICATIONS

PCT International Search Report dated Jul. 4, 2006.
Korean Office Action dated Jan. 27, 2006.

* cited by examiner

*Primary Examiner*—Frederick L Lagman
(74) *Attorney, Agent, or Firm*—KED & Associates, LLP

(57) ABSTRACT

A supporting member and a retaining wall structure having the same, and an associated building method are provided. The supporting member may include a pair of downward protrusions spaced apart and extending downward in the same direction, and a coupling portion that connects corresponding ends of the downward protrusions. The downward protrusions are configured to couple two or more layers of a retaining wall structure.

8 Claims, 8 Drawing Sheets

[Fig. 1]
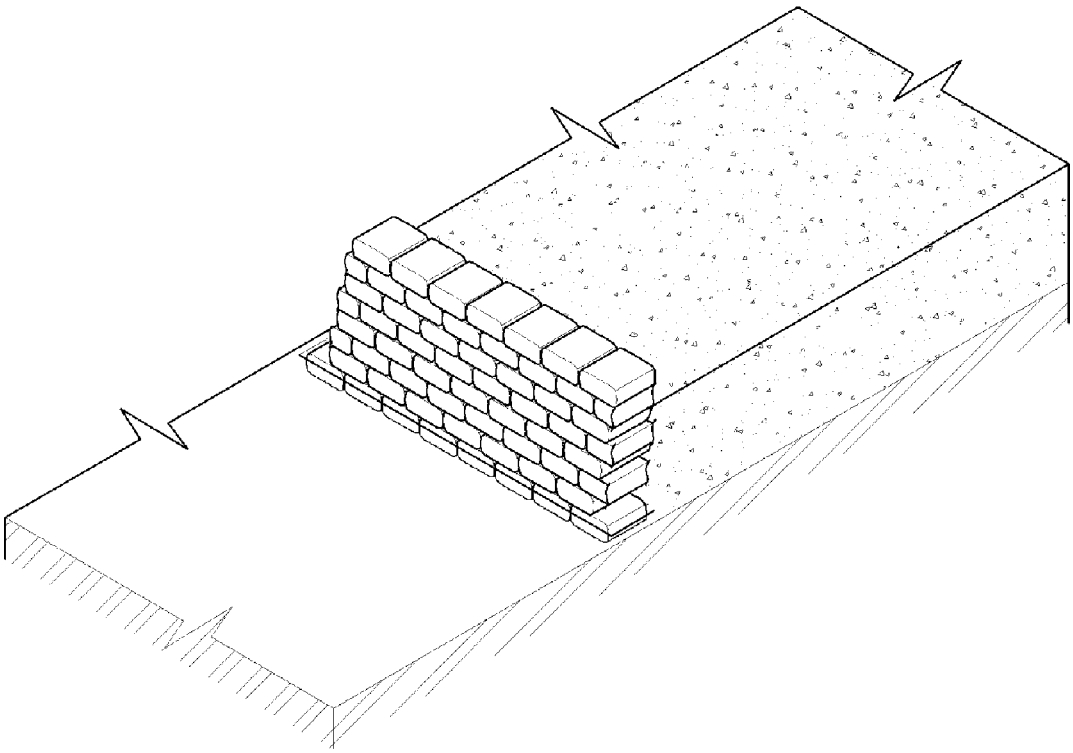
[Fig. 2]
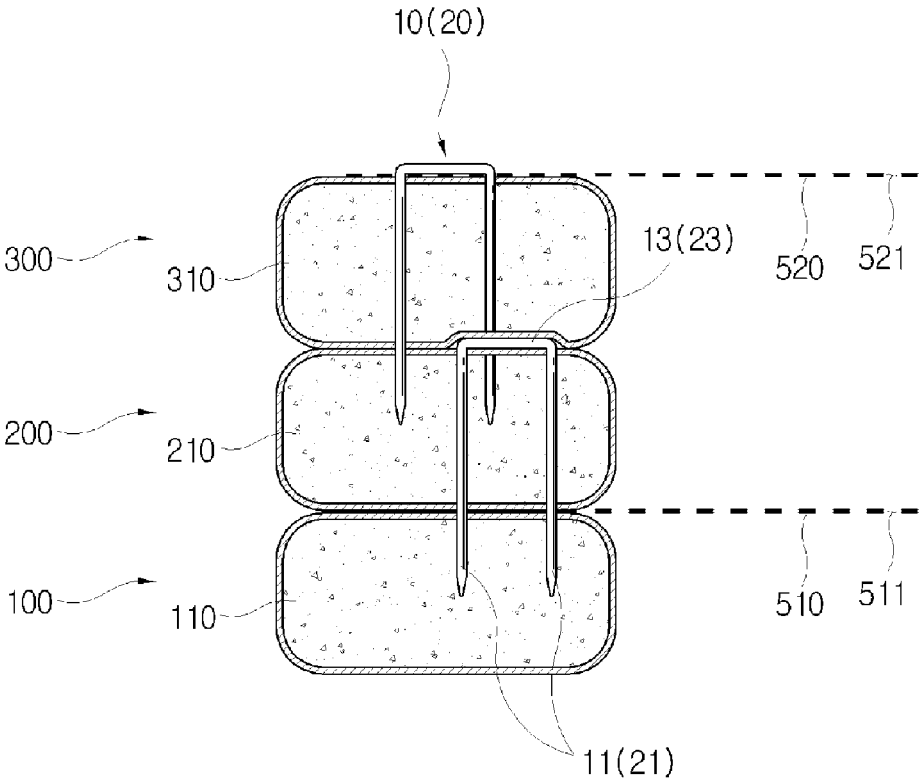

[Fig. 3]
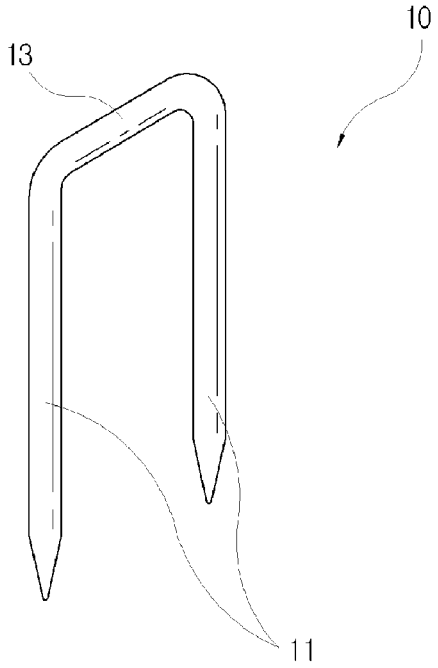
[Fig. 4]
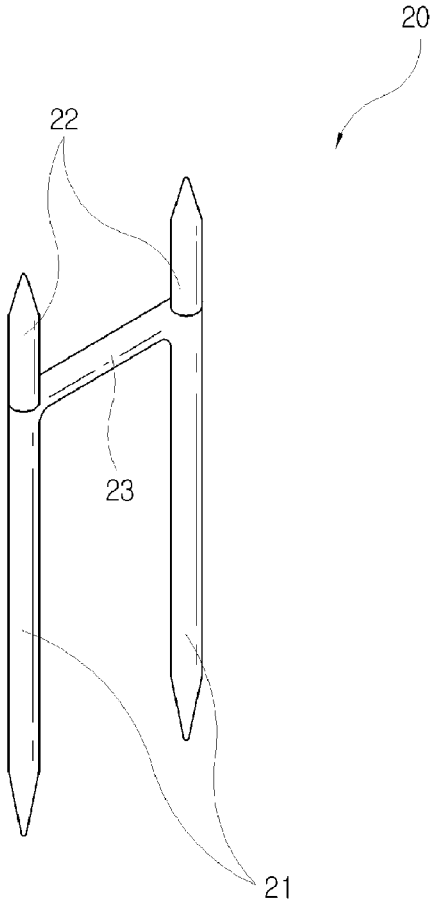

[Fig. 5]
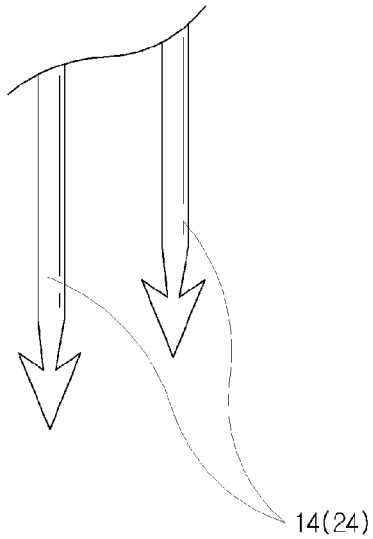
[Fig. 6]
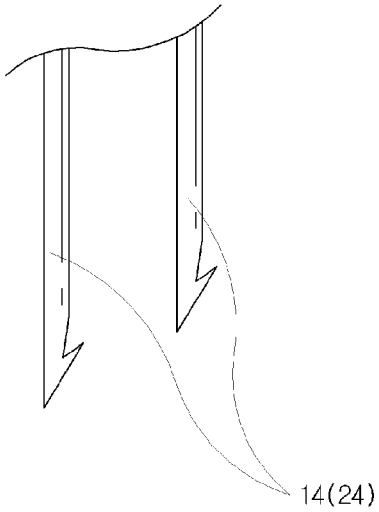
[Fig. 7]
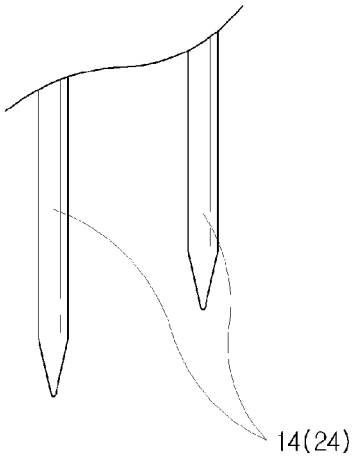

[Fig. 8]
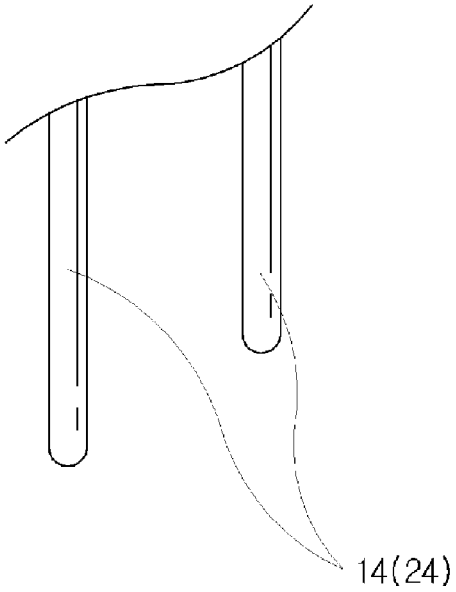
[Fig. 9]
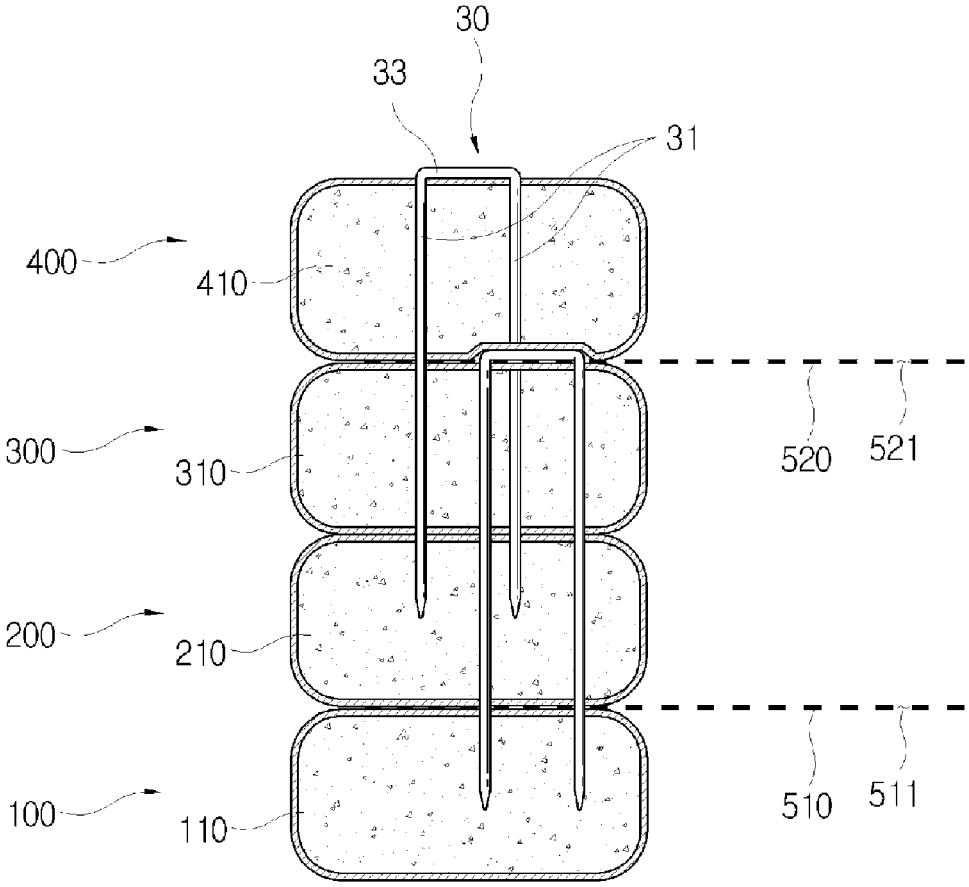

[Fig. 10]
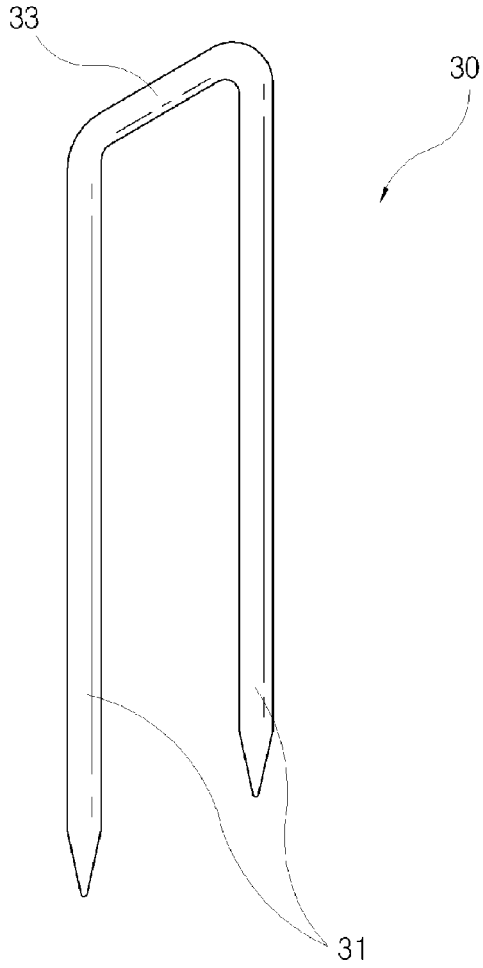
[Fig. 11]
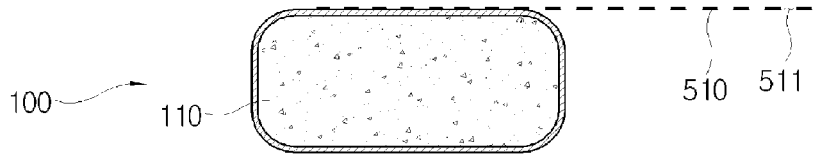
[Fig. 12]
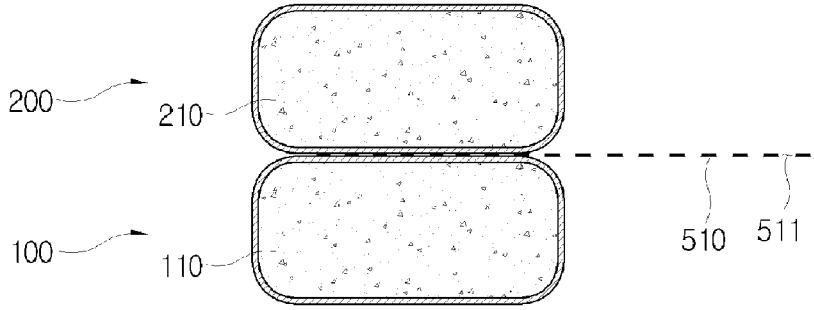

[Fig. 13]
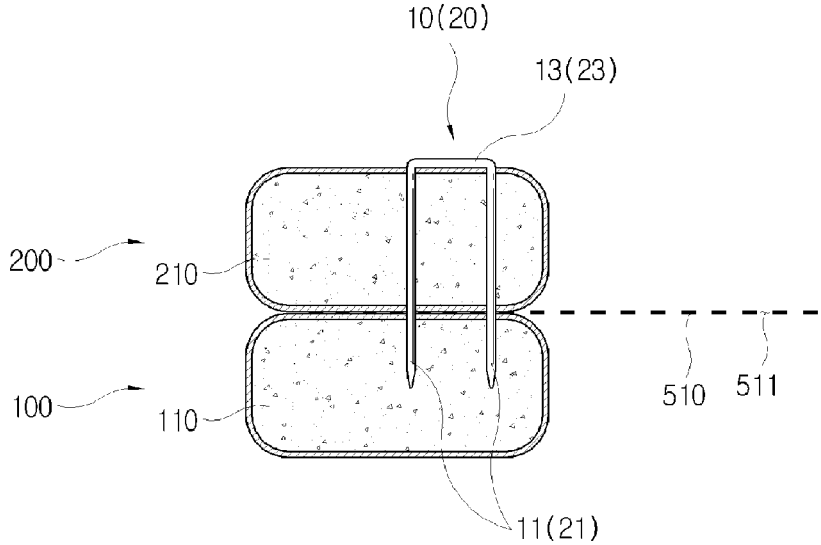
[Fig. 14]
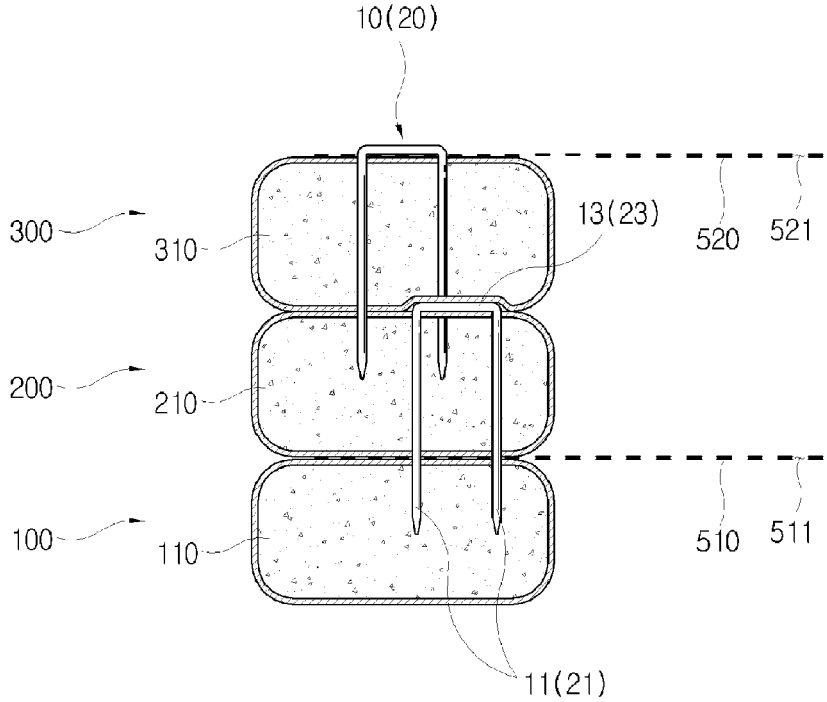
[Fig. 15]
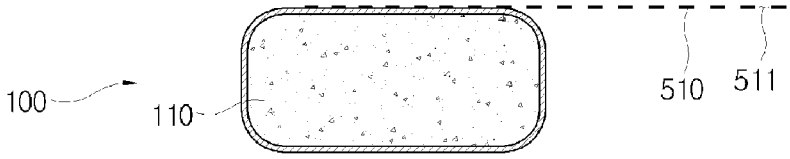

[Fig. 16]
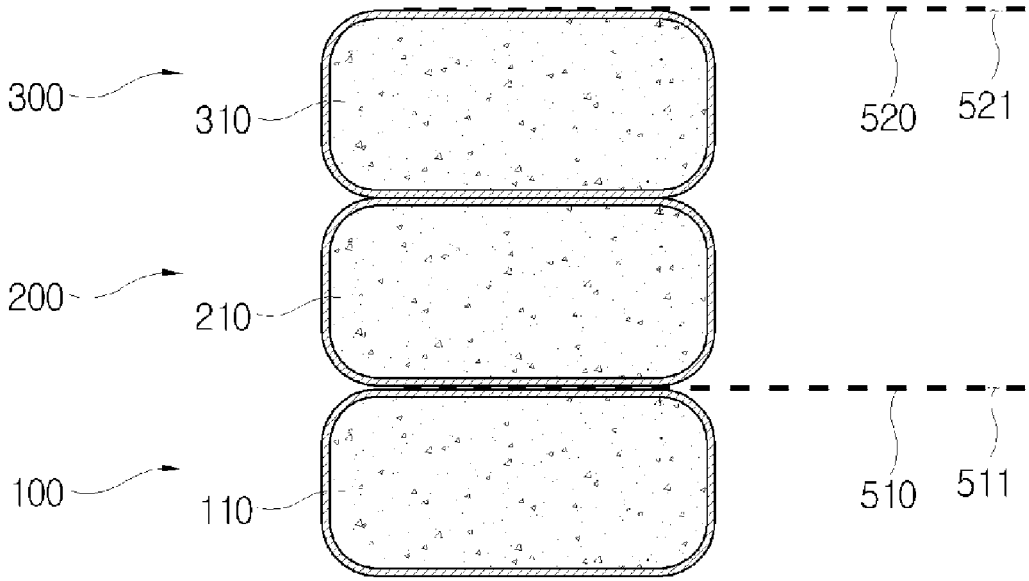
[Fig. 17]
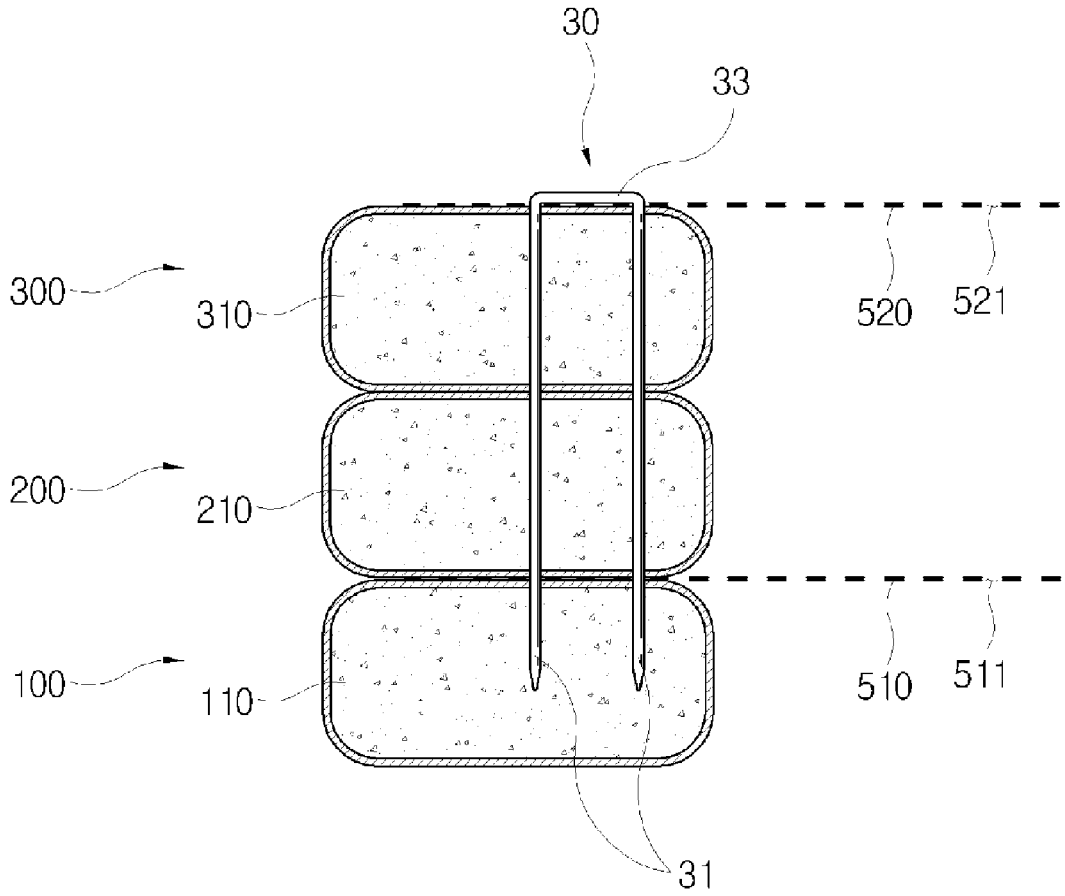

[Fig. 18]
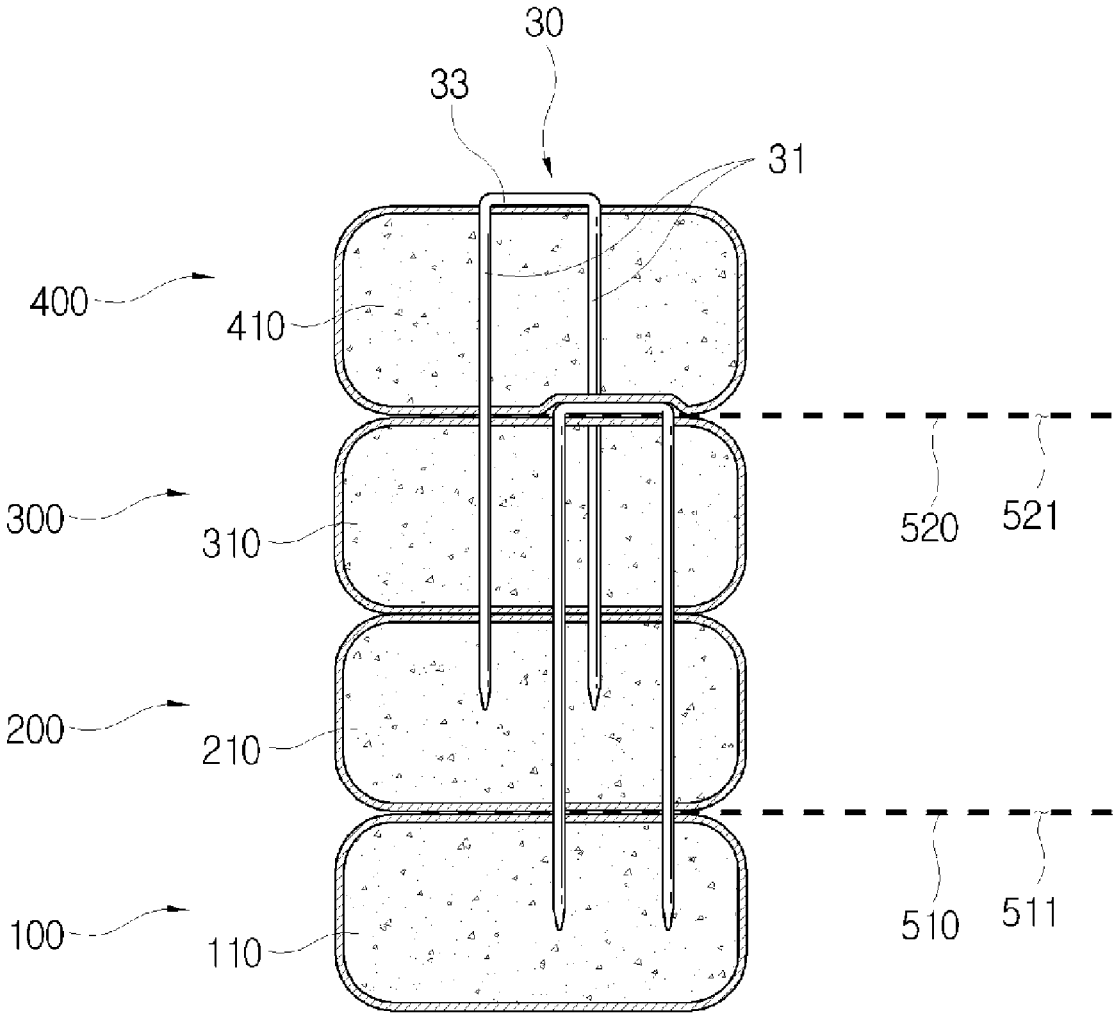

METHOD OF BUILDING A RETAINING WALL STRUCTURE

TECHNICAL FIELD

The present invention relates to a retaining wall structure; and more particularly, to a supporting member interposed between adjacent two horizontal retaining wall layers for supporting and coupling units of the retaining wall, a retaining wall structure having the same and a method of building the retaining wall structure.

BACKGROUND ART

A retaining wall is a structure erected to support a road slope and an excavated or filled embankment in order to prevent collapse of the road slope and the embankment due to the earth pressure. Generally, the lateral displacement is prevented by filling-up a space between the retaining wall and the road slope or the embankment with the back-filler containing fiber reinforcement having high tension and friction, i.e., geo-grid. That is, the retaining wall assures the stability of diversity structures such as road slopes and the embankments. Therefore, various retaining wall structures and methods of building thereof were introduced. For example, interlocking blocks were used to build a retaining wall that supports the earth pressure of a soil structure. Also, sand sacks or soil sacks were used instead of using the interlocking blocks.

When the sand sacks or the soil sacks are used to build the retaining wall, the retaining wall is built without fixing those sacks each others and their positions in the retaining wall are maintained only by their gravity. Therefore, if the back-filler portion of the retaining wall is sunken after building the retaining wall with those sacks, the vertical shape of the retaining wall is easily deformed by the horizontal shearing force arisen between the retaining walls. As a result, the reinforcement, i.e., geo-grid, in the back-filler is destroyed. Therefore, the retaining wall according to the related art has highly limited conditions of the height and the slop, and the durability thereof is low.

DISCLOSURE

Technical Problem

It is, therefore, an object of the present invention to provide a supporting member for supporting and coupling vertically-adjacent retaining wall units to hold a horizontal shearing force arisen between horizontal retaining wall layers so as to improve the durability of the retaining wall.

It is other object of the present invention to provide a retaining wall structure having the supporting member and a method of building a retaining wall structure using the same for improving the durability.

Technical Solution

In accordance with one aspect of the present invention, there is provided a supporting member for a retaining wall structure including: a pair of downward protrusions spaced apart and extended to one direction; and a coupling portion for coupling one ends of downward protrusions and being connected to each of the one ends of downward protrusions about vertically to a projecting direction of the downward protrusions.

The supporting member may further include a pair of upward protrusions projected from the coupling portion in a direction opposite to the downward protrusions.

Each of the downward protrusions may include an arrowhead shaped portion at a projected end thereof.

In accordance with another aspect of the present invention, there is provided a retaining wall structure including: a first horizontal retaining wall layer formed of a plurality of first retaining wall units closely arranged in a horizontal direction; a second horizontal retaining wall layer formed of a plurality of second retaining wall units closely and horizontally arranged on the first horizontal retaining wall layer in parallel; and a supporting member disposed on the second horizontal retaining wall layer to support the second retaining wall unit and the first retaining wall unit together, where the supporting member includes a pair of downward protrusions spaced apart and extended in one direction which are inserted into the first retaining wall unit after passing through the second retaining wall unit and a coupling portion coupling the downward protrusions by being connected to each end of the downward protrusions about vertically.

The retaining wall structure may further include a first geo-grid sheet having one end interposed between the first horizontal retaining wall layer and the second horizontal retaining wall layer, other end extended to a back-filler soil supported by the retaining wall units, and a plurality of through holes to receive the downward protrusions.

In accordance with still another aspect of the present invention, there is provided a retaining wall structure including: a first horizontal retaining wall layer formed of a plurality of first retaining wall units closely arranged in a horizontal direction; a second horizontal retaining wall layer formed of a plurality of second retaining wall units closely and horizontally arranged on the first horizontal retaining wall layer in parallel; a third horizontal retaining wall layer formed of a plurality of third retaining wall units closely and horizontally arranged on the second horizontal retaining wall layer in parallel; and a supporting member disposed on the third horizontal retaining wall layer to support the third, the second and the first retaining wall units together, where the supporting member includes a pair of downward protrusions spaced apart and extended in one direction which are inserted into the first retaining wall unit after passing through the third and the second retaining wall units and a coupling portion coupling the downward protrusions by being connected to each end of the downward protrusions about vertically.

The retaining wall structure may further include a first geo-grid sheet and a second geo-grid sheet each of which has one end interposed between the first horizontal retaining wall layer and the second horizontal retaining wall layer or disposed on the third horizontal retaining wall layer, other end extended to a back-filler soil supported by the retaining wall units, and a plurality of through holes to receive the downward protrusions.

In accordance with further still another aspect of the present invention, there is provided a method of building a retaining wall structure including: forming a first horizontal retaining wall layer by arranging a plurality of first retaining units to be closely each others in a horizontal direction; forming a second horizontal retaining wall layer on the first horizontal retaining wall layer in parallel by arranging a plurality of second retaining units on the first horizontal retaining wall layer to be closed each others in a horizontal direction; and nailing a supporting member into the second horizontal retaining wall layer where the supporting member includes a pair of downward protrusions spaced apart and extended in one direction and a coupling portion coupling the downward protrusions by being connected to each one end of the downward protrusions about vertically, and the downward protrusions are inserted into the first retaining wall unit after passing through the second retaining wall unit.

In accordance with further still another aspect of the present invention, there is provided a method of building a retaining wall structure including: forming a first horizontal retaining wall layer by arranging a plurality of first retaining units to be closely each others in a horizontal direction; forming a second horizontal retaining wall layer on the first horizontal retaining wall layer in parallel by closely and horizontally arranging a plurality of second retaining units on the first horizontal retaining wall layer; forming a third horizontal retaining wall layer on the second horizontal retaining wall layer in parallel by closely and horizontally arranging a plurality of third retaining units on the second horizontal retaining wall layer; and nailing a supporting member into the third horizontal retaining wall layer where the supporting member includes a pair of downward protrusions spaced apart and extended in one direction and a coupling portion coupling the downward protrusions by being connected to each one end of the downward protrusions about vertically, and the downward protrusions are inserted into the first retaining wall unit after passing through the third and the second retaining wall units.

The supporting member may further include a pair of upward protrusions projected from the coupling portion in an opposite direction of the downward protrusions.

Each of the downward protrusions may have an arrowhead shaped portion at a projected end thereof.

The retaining wall unit may be a sand sack or a soil sack.

The retaining wall unit may be made of material having gradual-hardening characteristics which is hardened after completely building the retaining wall.

ADVANTAGEOUS EFFECTS

In the supporting member, the retaining wall structure having the same and a building method thereof according to the present invention, the supporting member supports and couples vertically-adjacent retaining wall units to hold a horizontal shearing force arisen between horizontal retaining wall layers. Therefore, durability of the retaining wall having the same is enhanced.

Especially, the protrusion of the supporting member according to the present invention is inserted into the retaining wall units which is arranged two units below the supporting member after penetrating the retaining wall unit which is arranged right bellow the supporting member. Therefore, the durability of the retaining wall having the same is further enhanced.

DESCRIPTION OF DRAWINGS

The above and other objects and features of the present invention will become apparent from the following description of the preferred embodiments given in conjunction with the accompanying drawings, in which:

FIG. 1 is a perspective view of a retaining wall structure according to an embodiment of the present invention;

FIG. 2 is a cross-sectional view of a retaining wall structure with a supporting member according to an embodiment of the present invention;

FIGS. 3 through 8 are perspective views showing embodiments of the supporting member shown in FIG. 2;

FIG. 9 is a cross-sectional view of a retaining wall structure with a supporting member according to another embodiment of the present invention;

FIG. 10 is a perspective view of the supporting member shown in FIG. 9;

FIGS. 11 through 14 are conceptual views for describing a method of building a retaining wall according an embodiment of the present invention; and FIGS. 15 through 18 are conceptual views for describing a method of building a retaining wall according another embodiment of the present invention.

BEST MODE FOR THE INVENTION

Other objects and aspects of the invention will become apparent from the following description of the embodiments with reference to the accompanying drawings, which is set forth hereinafter.

FIG. 1 is a perspective view of a retaining wall structure according to an embodiment of the present invention, and FIG. 2 is a cross-sectional view of a retaining wall structure with a supporting member according to an embodiment of the present invention.

As shown in FIGS. 1 and 2, the retaining wall structure according to the present embodiment includes: a first horizontal retaining wall layer 100; a second horizontal retaining wall layer 200 formed on the first horizontal retaining wall layer 100 in parallel; a third horizontal retaining wall layer 300 formed on the second horizontal retaining wall layer 200 in parallel; and supporting members 10 and 20 nailed on the second horizontal retaining wall layer 200 and the third horizontal retaining wall layer 300, respectively.

The first horizontal retaining wall layer 100 is formed of a plurality of first retaining wall units 110 which are closely and horizontally arranged each others. The second horizontal retaining wall layer 200 is also formed of a plurality of second retaining wall units 210 closely and horizontally arranged each others on the first horizontal retaining wall layer 100. The third horizontal retaining wall layer 300 is also formed of a plurality of third retaining wall units 310 closely and horizontally arranged one another on the second horizontal retaining wall layer 200. It is preferable that the first, the second and the third retaining wall units 110, 210 and 310 may be a sand sack or a soil sack. Also, those retaining wall units 110 and 210 may be a sack containing the composition of the sand and the soil. Instead of using the sand sack, the soil sack or the composition thereof, blocks made of material having characteristics of gradual hardening may be used. For example, the first, the second and the third retaining wall units 110, 210 and 310 may be wet clay blocks which are hardened after completely building the retaining wall.

Each of the supporting members 10 and 20 includes: a pair of downward protrusions 11 or 21 that are spaced apart and extended in one direction; and coupling portion 13 or 23 for coupling one ends of the downward protrusions 11 or 21. The coupling portion 13 or 23 is connected to both of the one ends of the downward protrusions 11 or 21 about vertically. In order to support vertically adjacent retaining wall units such as the first retaining wall unit 110 and the second retaining wall unit 210 or the second retaining wall unit 210 and the third retaining wall unit 310, the protrusions 21 of the supporting member 20 are inserted into the first retaining wall unit 110 after passing through the second retaining wall unit 210, and the protrusions 11 of the supporting member 10 are also inserted into the second retaining wall unit 210 after passing through the third retaining wall unit 310. Accordingly, the coupling portions 23 and 13 are positioned on a top surface of the second retaining wall unit 210 or the third retaining wall unit 310, respectively.

FIGS. 3 through 5 are perspective views showing various embodiments of the supporting member shown in FIG. 2.

As shown in FIG. 3, the supporting member 10 includes a pair of downward protrusions 11 that are spaced apart and extended in one direction and a coupling portion 13 for coupling one ends of the downward protrusions 11 together. The coupling portion 13 is connected to each of the one ends of the downward protrusions 11 about vertically. As shown in FIG. 4, the supporting member may further include upward protrusions 22 extended from the coupling portion 23 in a direction opposite to the extending direction of the downward protrusions 21.

FIGS. 5 and 6 show arrow-headed protrusions of the supporting member. The pair of downward protrusions 11 or 21 may have arrowhead shaped portions 14 and 24 at projected ends thereof so that the downward protrusions are not easily taken off from the sand sack or the soil sack after the downward protrusions are inserted into the soil sack or the sand sack. It is preferable that the arrowhead portions 14 and 24 have a shape of full arrowhead or a shape of half arrowhead as shown in FIGS. 5 and 6. Also, the downward protrusions may have sharp cone shaped end portions to be smoothly nailed into the retaining wall units as shown in FIG. 7. Furthermore, it is possible to shape the end portions of the downward protrusions to be rounded as shown in FIG. 8 because the downward protrusions is made to have a shape of thin bar. Moreover, the downward protrusions may be formed in a hook shape. Such arrowhead shaped portions 14 and 24 allow the supporting members to firmly connect the first retaining wall unit 110 and the second retaining wall unit 210 or the second retaining wall unit 210 and the third retaining wall unit 310.

The retaining wall structure according to the present embodiment further includes a first geo-grid sheet 510 having one end interposed between the first horizontal retaining wall layer 100 and the second horizontal retaining wall layer 200. The other end of the first geo-grid sheet 510 extends into the filling such as a back-filler soil supported by the retaining wall units 110, 210 and 310. A plurality of through holes 511 is formed on the first geo-grid sheet 510. The downward protrusions 11 and 21 of the supporting members 10 and 20 are inserted into the retaining wall units 110, 210 and 310 after passing through the through holes 511 formed on the first geo-grid sheet 510. Therefore, the first geo-grid sheet 510 is firmly interposed and fixed between the first horizontal retaining wall layer 100 and the second horizontal retaining wall layer 200.

Until now, the retaining wall according to present embodiment is described as including only three horizontal retaining wall layers 100, 200 and 300. However, it is obvious to those skilled in the art that the present invention can be embodied identically into a retaining wall having more than four horizontal retaining wall layers.

Hereinafter, a retaining wall structure according to another embodiment of the present invention will be described with reference to FIG. 9. FIG. 9 is a cross-sectional view of a retaining wall structure according to another embodiment of the present invention. Like numeral references denotes like elements in FIGS. 2 and 9. Therefore, detailed descriptions thereof are omitted.

Referring to FIG. 9, the retaining wall structure according to the another embodiment includes: a first horizontal retaining wall layer 100; a second horizontal retaining wall layer 200 formed on the first horizontal retaining wall layer 100 in parallel; a third horizontal retaining wall layer 300 formed on the second horizontal retaining wall layer 200 in parallel; and a supporting member 30 disposed on the third horizontal retaining wall layer 300. The retaining wall structure further includes a fourth horizontal retaining wall layer 400 formed on the third horizontal retaining wall layer 300 and a supporting member 30 disposed on the fourth horizontal retaining wall layer 400.

The fourth horizontal retaining wall layer 400 is formed of a plurality of fourth retaining wall units 410 closely arranged in a horizontal direction. The fourth horizontal retaining wall layer 400 may be built using sand sacks, soil sacks or material having gradual hardening characteristics which is hardened after completely building the retaining wall similar to the first, the second and the third retaining wall layers 100, 200 and 300.

Similar to the supporting members shown in FIG. 2, the supporting member 30 includes: a pair of downward protrusions 31 formed to be spaced apart and extended to one direction; and a coupling portion 33 connecting both one ends of the downward protrusions 31. The coupling portion 33 is connected to each of the one ends of the downward protrusions 31 about vertically. The downward protrusions 31 of supporting member 30 are nailed into the first retaining wall unit 110 after passing through the third and the second retaining wall units 310 and 210. Therefore, the length of the downward protrusion 31 must be long enough to penetrate through the third and the second retaining wall units 310 and 210. Identically, other downward protrusions 31 of supporting member 30 are nailed into the second retaining wall unit 210 after passing through the fourth and the third retaining wall units 410 and 310. The supporting member 30 shown in FIG. 9 may be formed to have various shapes shown in FIGS. 3 through 8.

The retaining wall according to another embodiment further include a first and a second geo-grid sheets 510 and 520 each of which has one end interposed between the first and the second horizontal retaining wall layers 100, 200, and between the third and the fourth horizontal retaining wall layers 300 and 400. The other end of the geo-grid sheets 510 and 520 is extended into the filling such as the back-filler soil supported by the retaining wall units 110, 210, 310 and 410. A plurality of through holes 511 and 521 is formed on the geo-grid sheets 510 and 520. The downward protrusions 31 pass through the through holes 511 and 521 and then inserted into the first and the second retaining wall units. Therefore, the first and the second geo-grid sheets 510 and 520 are stably interposed and firmly fixed between the horizontal retaining wall layers 100, 200, 300 and 400.

The retaining wall according to another embodiment is described as including only four horizontal retaining wall layers 100, 200, 300 and 400. However, it is obvious to those skilled in the art that the present invention can be embodied identically into a retaining wall having more than five horizontal retaining wall layers.

Hereinafter, a method of building a retaining wall according to an embodiment of the present invention will be described with reference to accompanying drawings.

FIGS. 11 through 14 are conceptual views for describing a method of building a retaining wall according to an embodiment of the present invention. Like numeral references denote like elements in FIG. 2 and FIGS. 11 through 14. Therefore, detailed descriptions thereof are omitted.

At first, a plurality of the first retaining wall units 110 is closely arranged each others in a horizontal direction to form the first horizontal retaining wall layer 100 as shown in FIG. 11. Selectively, one end of the first geo-grid sheet 510 having through holes 511 is placed on the first horizontal retaining wall layer 100 after forming the first horizontal retaining wall layer 100.

Then, the second horizontal retaining wall layer 200 is formed on the first horizontal retaining wall layer 100 by closely arranging the second retaining wall units 210 in a horizontal direction on the first horizontal retaining wall layer 100 as shown in FIG. 12.

Then, the supporting member 10 is nailed on the second horizontal retaining wall layer 200 so that the supporting member 10 is inserted into the first retaining wall unit 110 after passing through the second retaining wall unit 210 as shown in FIG. 13. If the one end of first geo-grid sheet 510 is disposed on the first horizontal retaining wall layer 100, the downward protrusions 11 pass through the through wholes 511 of the first geo-grid sheet 510.

After nailing the supporting member 10, the third retaining wall units 310 are arranged closely to one another in a horizontal layer to form the third horizontal retaining wall layer 300 as shown in FIG. 14. Then, the one end of the second geo-grid 520 having a plurality of through holes 521 may be arranged on the third retaining wall layer 300. The supporting member 20 is nailed on the third retaining wall layer 300 so that the downward protrusions 21 thereof are inserted into the second retaining wall unit 210 after passing through the third retaining wall unit 310. If the one end of second geo-grid sheet 520 is disposed on the third horizontal retaining wall layer 300, the downward protrusions 21 pass through the through holes 521 of the second geo-grid sheet 520.

FIGS. 15 through 18 are conceptual views for describing a method of building a retaining wall according another embodiment of the present invention. Like numeral references denote like elements in FIG. 2 and FIGS. 15 through 18. Therefore, the detailed descriptions thereof are omitted.

At first, a plurality of first retaining units 100 is closely arranged in the horizontal direction to form the first horizontal retaining wall layer 100 as shown in FIG. 15. As described above, the one end of the first geo-grid sheet 510 having a plurality of through holes 511 may be placed on the first horizontal retaining wall layer 100.

As shown in FIG. 16, the second horizontal retaining wall layer 200 is formed on the first horizontal retaining wall layer 100 in parallel. That is, a plurality of the second retaining wall units 210 is closely arranged on the first horizontal retaining wall layer 100 in the horizontal direction. Then, the third horizontal retaining wall layer 300 is formed on the second horizontal retaining wall layer 200 in parallel by closely arranging the third retaining wall units 310 on the second horizontal retaining wall layer 200 in parallel. Selectively, the second geo-grid sheet 520 having a plurality of through holes 521 may be disposed on the third horizontal retaining wall layer 300.

As shown in FIG. 17, the supporting member 30 is nailed on the third horizontal retaining wall layer 300. Accordingly, the downward protrusions 31 are inserted into the first retaining wall unit 110 after passing through the third and the second retaining wall units 310 and 210. If the first and the second geo-grid sheets 510 and 520 are disposed on the first and the third horizontal retaining wall layers 100 and 300, the downward protrusions 31 pass through the through holes 511 and 521 of the first and the second geo-grid sheets 510 and 520.

After nailing the supporting member 30, the fourth horizontal retaining wall layer 400 is formed on the third horizontal retaining wall layer 300 by closely arranging the fourth retaining wall units 410 in parallel on the third horizontal retaining wall layer 300 as shown in FIG. 18. Then, the supporting member 30 is nailed on the fourth horizontal retaining wall layer 400. As a result, the downward protrusions 31 are inserted into the second retaining wall unit 210 after passing through the fourth and the third retaining wall units 410 and 310. If the one end of the second geo-grid sheet 520 is disposed on the third horizontal retaining wall layer 300, the downward protrusions 311 pass through the through holes 521 of the second geo-grid sheet 520.

While the present invention has been described with respect to certain preferred embodiments, it will be apparent to those skilled in the art that various changes and modifications may be made without departing from the scope of the invention as defined in the following claims.

The invention claimed is:

1. A method of building a retaining wall structure, the method comprising:

arranging a plurality of first retaining units adjacent to each other in a horizontal direction to form a first horizontal retaining wall layer;

arranging a plurality of second retaining units adjacent to each other in a horizontal direction on the first horizontal retaining wall layer to form a second horizontal retaining wall layer on the first horizontal retaining wall layer that is parallel to the first horizontal retaining wall layer;

arranging a plurality of third retaining units adjacent to each other in a horizontal direction on the second horizontal retaining wall layer to form a third horizontal retaining wall layer on the second horizontal retaining wall layer that is parallel to the second horizontal retaining wall layer;

coupling the first, second and third horizontal retaining wall layers with one of a plurality of supporting, members, wherein each supporting member includes a pair of downward protrusions spaced apart and each extending in a first direction and a coupling portion that connects respective proximal ends of the pair of downward protrusions, wherein coupling the first, second and third horizontal retaining wall layers comprises driving the pair of downward protrusions through one of the plurality of third retaining units, through a corresponding one of the plurality of second retaining units, and into a corresponding one of the plurality of first retaining units, with the coupling portion positioned on an upper surface of the third horizontal retaining wall layer;

arranging a plurality of fourth retaining units adjacent to each other in a horizontal direction on the third horizontal retaining wall layer to form a fourth horizontal retaining wall layer on the third horizontal retaining wall layer that is parallel to the third horizontal retaining wall layer; and coupling the second, third and fourth horizontal retaining wall layers with another of the plurality of supporting members, comprising driving the pair of downward protrusions through one of the plurality of fourth retaining units, through a corresponding one of the plurality of third retaining units, and into a corresponding one of the plurality of second retaining units, with the coupling portion positioned on an upper surface of the fourth horizontal retaining wall layer.

2. The method of claim 1, wherein each supporting member further comprises a pair of upward protrusions that extend from the coupling portion in a second direction that is opposite the first direction of the pair of downward protrusions.

3. The method of claim 2, wherein arranging a plurality of second retaining units adjacent to each other in a horizontal direction on the first horizontal retaining wall layer comprises impaling the plurality of second retaining units onto the pair of upward protrusions extending upward from the coupling portion positioned on an upper surface of the first horizontal retaining wall layer.

4. The method of claim 1, wherein each of the pair of downward protrusions has an arrowhead shaped portion at a distal end thereof.

5. The method of claim 1, wherein each of the first, second, third and fourth retaining wall units comprises a sand sack or a soil sack.

6. The method of claim 1, wherein each of the first second, third and fourth retaining wall units is made of a material having gradual-hardening characteristics which is configured to be hardened after the retaining wall structure is complete.

7. The method of claim 1, further comprising:

arranging a plurality of fifth retaining units adjacent to each other in a horizontal direction on the fourth horizontal retaining wall layer to form a fifth horizontal retaining wall layer on the fourth horizontal retaining wall layer that is parallel to the fourth horizontal retaining wall layer; and coupling the third, fourth and fifth horizontal retaining wall layers with another of the plurality of supporting members, comprising driving the pair of downward protrusions through one of the plurality of fifth retaining units, through a corresponding one of the plurality of fourth retaining units, and into a corresponding one of the plurality of third retaining units, with the coupling portion positioned on an upper surface of the fifth horizontal retaining wall layer.

8. The method of claim 1, wherein each of the pair of downward protrusions comprises a substantially cylindrical body portion that extends from its proximal end to its distal end, and a pointed tip provided at its distal end.

* * * * *